United States Patent [19]

Lasseter et al.

[11] Patent Number: 4,471,840

[45] Date of Patent: Sep. 18, 1984

[54] METHOD OF COAL DEGASIFICATION

[76] Inventors: Paul A. Lasseter; Fred C. Hollingsworth, both of 1800C Hackberry Ln., Tuscaloosa, Ala. 35401

[21] Appl. No.: 507,828

[22] Filed: Jun. 23, 1983

[51] Int. Cl.[3] ..... E21B 43/267; E21B 37/12

[52] U.S. Cl. ..... 166/280; 166/308; 299/12; 299/16

[58] Field of Search ..... 166/280, 308, 307, 369; 299/12, 16, 2

[56] References Cited

U.S. PATENT DOCUMENTS

| | | | |
|---|---|---|---|
| 3,349,851 | 10/1967 | Huitt et al. | 166/280 |
| 3,384,416 | 5/1968 | Ruehl et al. | 299/16 |
| 3,481,401 | 12/1969 | Graham | 166/280 |
| 3,709,300 | 1/1973 | Pye | 166/280 |
| 3,814,480 | 6/1974 | Dahl et al. | 166/308 X |
| 3,818,990 | 6/1974 | Coulter | 166/280 |
| 3,934,649 | 1/1976 | Pasini et al. | 166/308 X |
| 4,033,415 | 7/1977 | Holtmyer et al. | 166/308 |
| 4,245,702 | 1/1981 | Haafkens et al. | 166/280 X |
| 4,283,089 | 8/1981 | Mazza et al. | 166/308 X |

*Primary Examiner*—Stephen J. Novosad

*Attorney, Agent, or Firm*—Robert A. Kent; Thomas R. Weaver

[57] ABSTRACT

A method for producing methane gas and other gases present from a subterranean coal-containing formation comprising the creation of a fracture in the subterranean coal-containing formation, introduction of a propping agent into the open fracture after which at least a portion of the proppant is permitted to settle within the fracture, introduction of a substantially propping agent-free fluid into the open fracture to create an open channel over the propping agent and then permitting closure of the fracture upon the propping agent to leave a propped channel.

14 Claims, 3 Drawing Figures

METHOD OF COAL DEGASIFICATION

BACKGROUND OF THE INVENTION

1. Field of the Invention

The present invention relates to methods for degasifying subterranean coal-containing formations employing hydraulic fracturing techniques.

2. Brief Description of the Prior Art

It has long been known that many subterranean coal-containing formations contain significant quantities of methane gas and other gaseous materials. The porous fractured structure of coal, which contains an extensive network of ultrafine capillaries that pass in all directions through the coal, facilitates the movement of the gases through the coal. Because of the hazardous nature of methane gas and its ability to move through the coal, it has not been possible for miners to produce coal from formations containing large quantities of methane gas.

Recently, it has been found that by drilling boreholes into subterranean coal-containing formations that the methane gas and other gases can be drained from the formation and the gas can be recovered at the earth's surface. In some instances, sufficient quantities of gas are present to make it economically desirable to recover the gas for introduction into a commerical gas pipeline for sale, even though the coal deposit may not be of a quality sufficient to justify mining. Various attempts have been made to facilitate the flow of the gas from the subterranean formations, however, these methods have been hindered by the brittle, friable nature of coal.

One method has employed the creation of artificial fractures in the coal-containing formation in accordance with conventional fracturing treatments to facilitate hydrocarbon production from subterranean oil and gas formations. The artificial fracturing process causes the formation of many minute fractures in the coal in the face of the principal fractures. Because of the brittle nature of the coal, these fractures cause small particles to separate from the face of the principal fracture. Production of methane or other gases from the coal also causes spalling from the face of the fracture in the coal seam as the gas passes through the face. The fine particles of coal and other materials created by the fracturing process and by the passage of gases through the coal lodge in and seal off the natural and artificially created fractures in the coal seam and thereby substantially hinder the flow of gas through the coal.

It would be desirable to provide a method by which a subterranean coal-containing formation can be fractured and the fracture can be maintained substantially unblocked by spalled coal particles to permit the drainage of methane gas from the formation and subsequent mining of the coal.

SUMMARY OF THE INVENTION

The surprising discovery now has been made that the method hereinafter described permits the removal of occluded methane gas and other fluids from subterranean coal-containing formations to permit subsequent mining of the coal. To remove the methane gas, and any other gases present, a well bore is drilled into the subterranean coal-containing formation from the earth's surface and communication is established between the well bore and the coal-containing formation. A treatment fluid is introduced into the well bore at a sufficient rate and pressure to create at least one fracture in the formation. A quantity of a propping agent then is introduced into the fracture under controlled conditions such that at least a portion of the propping agent settles within the fracture to prevent the fracture from closing upon reduction in pressure on the fluid. A substantially proppant-free treatment fluid then is introduced into the fracture to wash the upper portion of the fracture substantially free of propping agent to create an open channel in the fracture. Injection of the treatment fluid is discontinued and the fracture is permitted to close upon the injected propping agent. The treatment fluid is permitted to drain off into the formation or at least a portion of the fluid can be flowed back to the well bore for recovery at the surface. The methane gas contained in the coal seam flows from the formation through the open channel in the fracture to the well bore for recovery. The particles of coal or other fine particles which spall from the face of the fracture during gas flow into the fracture pass through the open channel above the propping agent and at least a portion of the particles enter the well bore. The particles are removed from the gas and the gas can be introduced into commerical pipelines for sale. The channel created by the method of the present invention substantially eliminates the plugging problem caused by bridging of the spalled particles in the fracture in the coal-containing formation.

DESCRIPTION OF THE PREFERRED EMBODIMENT

In the mining of subterranean coal-containing formations; methane gas often is encountered. In some formations, the concentration of the methane gas in the coal seam can be sufficiently large that it is extremely hazardous to miners. The methane gas is both highly explosive when present in high concentrations in the coal seam and poisonous, if breathed by the miners. For these reasons, such coal-containing formations previously have not been mined to any significant extent.

It has been found that the methane gas and other fluids contained in the subterranean coal-containing formation can be removed from the formation by drilling boreholes into the coal seam and permitting the methane gas and other fluids to drain from the coal seam into the borehole. In some formations, the quantity of methane gas is sufficient to justify the expenditures necessary to gather the gas for injection into commercial pipelines for sale, whether or not the coal is of a quality to justify mining.

The discovery now has been made that by creating an open fracture from the well bore into the coal seam, the quantity of methane gas that can be removed from the subterranean formation is substantially increased. Coal often is an extremely brittle and friable material and normally, coal seams are highly faulted and fractured. These properties of the coal seam result in spalling of the particles comprising the coal seam into any opening into which methane gas moves from the formation. The particles are of a sufficient size that they can bridge across small fractures in the coal seam and prevent the flow of methane gas from the coal. Artificial fracturing of a coal seam aggravates the fine particle problem by creating many additional fine fractures in the coal which then cause additional particles to separate from the face of the artificial fracture in the coal seam.

Figure 1:
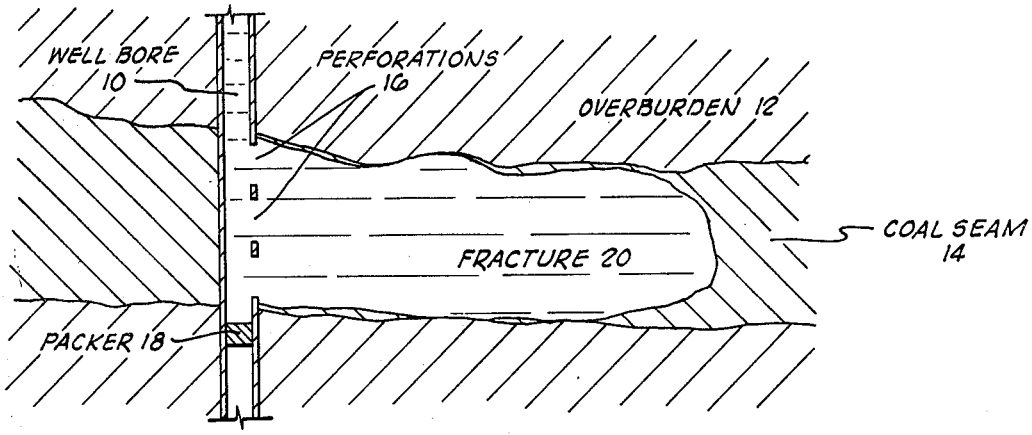
FIG. 1 diagrammatically illustrates the formation of a fracture in a subterranean coal-bearing formation.

Turning now to FIG. 1, a subterranean coal-containing formation is illustrated. A cased well bore 10 is drilled by conventional means to establish communication through an overburden 12 between the earth's surface and the subterranean coal-containing formation represented by a coal seam 14. Communication is established between the well bore 10 and coal seam 14 by perforations 16 in the casing of the well bore 10. The perforations 16 can be formed by any means known to individuals skilled in the art which results in communication between the well bore 10 and coal seam 14. In some situations, it may be desirable to utilize an uncased well bore and, in that event, no perforations will be necessary. A packer 18 of conventional design is placed in the well bore to prevent fluids injected into the well bore from bypassing the coal seam 14. In the event an uncased well bore is employed, an additional packer may be set in the well bore above the coal seam 14 to isolate the coal seam to permit injection of fluids into the coal-containing portion of the subterranean formation. The use of such devices are well known by individuals skilled in the art of hydrocarbon production from subterranean formations.

A treatment fluid is introduced into well bore 10 from the upper end of the well bore at a sufficient rate and pressure to create at least one fracture 20 in the coal seam 14 upon injection into the coal-containing formation.

The treatment fluid can comprise substantially any aqueous or hydrocarbon-containing fluid. Preferably, the treatment fluid comprises water. While it is possible to admix viscosifying agents with the treatment fluid employed to create the initial fracture or fractures, viscosifying agents are not required.

Typical viscosifying agents which can be utilized comprise solvatable polysaccharides which include galactommanan gums, glucomannan gums and cellulose derivatives. Examples of viscosifying agents useful herein include guar gum, locust bean gum, karaya gum, sodium carboxymethylguar, hydroxyethylguar, hydroxypropylguar, sodium carboxymethylhydroxypropylguar, sodium carboxymethylcellulose, sodium hydroxyethylcellulose, sodium carboxymethylhydroxyethylcellulose and the like. A sufficient quantity of the viscosifying agent, if desired, is admixed with the treatment fluid to provide a desired viscosity in the fluid. Typically from about 1 to about 100 pounds of the viscosifying agent can be admixed with each thousand gallons of treatment fluid to viscosify the fluid.

The treatment fluid also can include a crosslinking agent in addition to the viscosifying agent. The crosslinking agent can comprise any of the compounds known to crosslink the viscosifying agent in a useful manner to increase the viscosity of the treatment fluid. Examples of crosslinking agents include organotitanates which feature the presence of titanium in the +4 oxidation state or zirconium chelates or salts which feature the presence of zirconium in the +4 oxidation state and the like.

Figure 2:
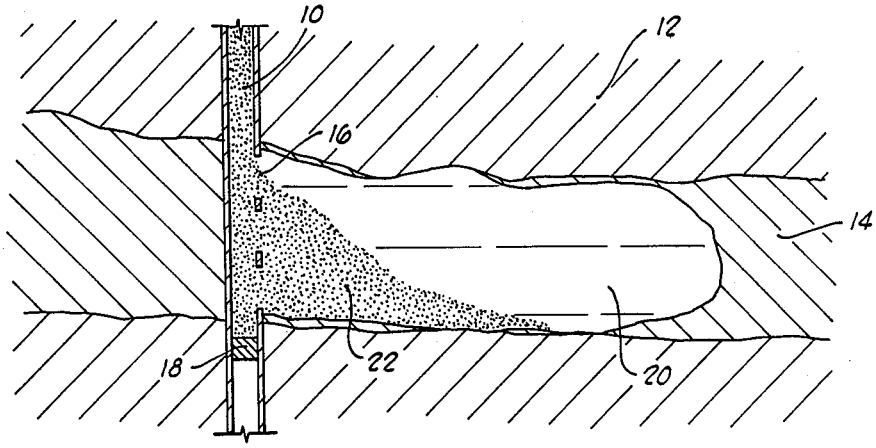
FIG. 2 diagrammatically illustrates the introduction of propping agent into the fracture.

After creation of the fracture, a propping agent is introduced into the treatment fluid and injected into the fracture. The placement of the propping agent is illustrated in FIG. 2 in which reference numeral 22 represents the propping agent. The propping agent can comprise any conventional material known by individuals in the art to be suitable for the described propping function. Examples of materials suitable for use as propping agents comprise sand, glass beads, sintered bauxite, resin-coated sand and the like. The quantity and size of the propping agent introduced into fracture 20 will depend upon the physical properties of the coal seam, the desired fracture length and propped width and other factors which are well known to individuals skilled in the fracturing of subterranean formations.

The treatment fluid in which the propping agent is transported to fracture 20 may contain a sufficient quantity of a viscosifying agent to provide a viscosity in the fluid such that the fluid is capable of efficiently transporting the propping agent without premature settling. However, often, only sufficient viscosifying agent is present to function as a friction reducer for the fluid.

After introduction of a sufficient desired quantity of propping agent into fracture 20, the propping agent is permitted to settle within fracture 20. Sufficient pressure is maintained on the treatment fluid within fracture 20 to prevent significant closure of fracture 20 while the propping agent is settling. When water is employed as the treatment fluid, the propping agent settles rapidly from the fluid upon entry into the fracture in the coal seam. The extent of the settling can be controlled by varying the injection rate of the treatment fluid when low viscosity fluids such as water are utilized.

Figure 3:
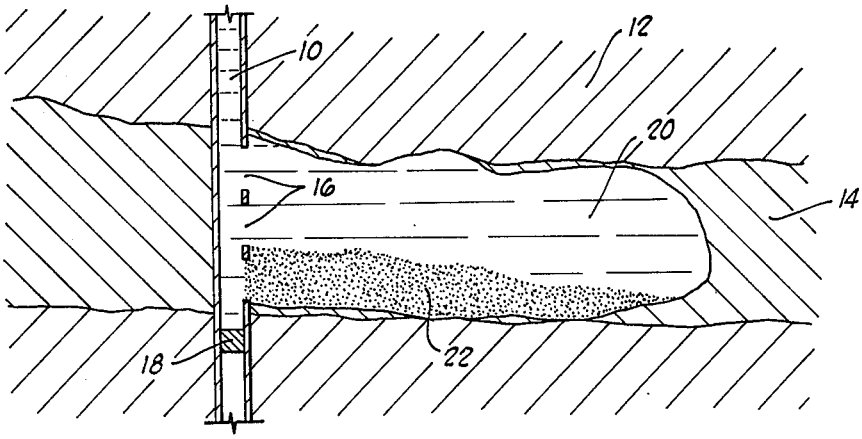
FIG. 3 diagrammatically illustrates the creation of the open channel above the propping agent in the fracture.

Thereafter, a quantity of substantially propping agent-free fluid is introduced through well bore 10 into fracture 20 to create an open channel over the upper portion of the propping agent in fracture 20 (See FIG. 3). This fluid can comprise the same fluid as the initial treatment fluid employed to create the fracture or any other suitable fluid. The injection of this fluid also removes any remaining proppant-laden treatment fluid from the region of the channel by displacing any remaining proppant-laden treatment fluid into the farthest extremities of fracture 20. The fracture then is permitted to close upon the settled propping agent whereby a propped fracture remains having an open channel above the propping agent of a sufficient width to permit minute particles of the coal seam which spall or otherwise enter into the fracture during the drainage of the gases present to pass through the fracture without detrimentally effecting the ability of the gases to flow through fracture 20.

Preferably, the quantity of propping agent employed is such that the channel subsequently created over the propping agent comprises at least about 40 percent and, most preferably, at least about 50 percent of the volume of the fracture 20 in the coal seam 14.

The treatment fluid can be permitted to dissipate in the coal seam or at least a portion of the fluid can be flowed back through well bore 10 for recovery at the surface of the well bore to permit the well bore to be placed on production.

The channel created by the method of the present invention substantially eliminates the bridging problem associated with the production of contained gases from subterranean coal-containing formations and also permits other formation fluids, such as water, to be drained to the well bore to facilitate further gas production by improving the permeability of the coal seam.

To further illustrate the method of the present invention, and not by way of limitation, the following example is provided.

In accordance with the method of the present invention, a well bore is drilled and cased to a depth of about 2,500 feet whereby it penetrates a subterranean coal-containing formation in Tuscaloosa County, Ala. The well bore is perforated to establish communication with the coal seam by conventional means.

A treatment fluid comprising water is introduced into the well bore and injected into the coal seam at a static pressure of about 900 psig. to create at least one fracture in the coal. Following the injection of about 10,000 gallons of the treatment fluid, 40,000 pounds of a propping agent comprising 10–20 mesh sand is introduced into the fracture at a rate of about 1 pound per gallon of treatment fluid. The propping agent rapidly settles from the treatment fluid due to the lack of a viscosifying agent in the fluid. An additional quantity of about 10,000 gallons of treatment fluid substantially free of propping agent then is introduced into the fracture in the coal seam to create an open channel above the settled proppant. Thereafter, the fracture is permitted to close and the treatment fluid is flowed back to the surface for recovery. The well bore subsequently is placed on production and has continuously produced methane-containing gas for a period of over twelve months.

In contrast to the preceeding description, a well bore drilled previously into the same formation, produced gas for less than 6 months before the spalled coal particles bridged across the fracture and substantially prevented further gas flow. In this instance, the well bore was perforated and fractured by traditional methods in which a treatment fluid is introduced into the coal seam to create a fracture and a propping agent then is injected into the fracture in an additional quantity of the treatment fluid. The fracture is permitted to close substantially immediately upon the injected propping agent and the treatment fluid is flowed back to the surface.

In an alternate embodiment of the present invention, the method may be employed to effect a remedial treatment on a well bore which has been blocked by fine particles which have separated from the face of the fracture in the coal seam. In this instance, a treatment fluid is introduced into the coal seam at a sufficient rate and pressure to reopen the existing fracture. Upon reopening of the fracture, the pressure is maintained for a sufficient period of time to permit at least a portion of the propping agent in the fracture to settle to the lower portion of the fracture. A quantity of substantially propping agent-free fluid then is introduced into the fracture to create the desired open channel in the upper portion of the fracture. The fracture then is permitted to close on the settled proppant.

This remedial treatment permits a fracture to be returned to production or increased in size without the use of additional propping agent by redistributing the propping agent that is present within the fracture.

While particular embodiments of the invention have been described, it is to be understood that such descriptions are presented for purposes of illustration only and that the invention is not limited thereto and that reasonable variations and modifications, which will be apparent to those skilled in the art, can be made without departing from the spirit or scope of the invention as set forth in the appended claims.

What is claimed is:

1. A method of fracturing a subterranean coal-containing formation to permit the removal of methane gas or other gases from the formation which comprises:

introducing a treatment fluid into said subterranean formation at a rate and pressure sufficient to create at least one fracture in said coal-containing formation;

introducing a quantity of a propping agent into said fracture in said coal-containing formation;

permitting at least a portion of said propping agent to settle within said fracture;

introducing a substantially propping agent-free fluid into said fracture to create a substantially propping agent-free channel in an upper portion of said fracture above said settled propping agent; and permitting said fracture to close upon said propping agent to create an open channel through which methane gas or other gases present in said formation can flow for removal from said subterranean coal-containing formation.

2. The method of claim 1 wherein said treatment fluid comprises an aqueous fluid.

3. The method of claim 1 wherein said propping agent is introduced into said fracture by transporting it in a quantity of said treatment fluid.

4. The method of claim 3 wherein the treatment fluid containing said propping agent also contains a quantity of a viscosifying agent.

5. The method of claim 1 wherein said propping agent comprises at least one member selected from the group consisting of sand, glass beads, resin-coated sand and sintered bauxite.

6. A method of producing methane or other gases present in a subterranean coal-containing formation penetrated by a well bore from said formation which comprises:

introducing a treatment fluid into said subterranean formation through said well bore at a rate and pressure sufficient to create at least one fracture in said subterranean formation;

while maintaining said fracture in an open position, introducing a quantity of a propping agent into said fracture in admixture with a quantity of said treatment fluid;

permitting at least a portion of said propping agent to settle to a lower portion of said open fracture;

introducing a substantially propping agent-free fluid into said open fracture to create a channel above said settled propping agent which is substantially free of propping agent; and permitting said open fracture to at least partially close upon said propping agent to form a propped channel in said subterranean formation through which said gases can flow for recovery from said subterranean formations.

7. The method of claim 6 wherein said treatment fluid comprises an aqueous fluid.

8. The method of claim 6 wherein said treatment fluid containing said propping agent also contains a viscosifying agent.

9. The method of claim 6 wherein said propping agent comprises at least one member selected from the group consisting of sand, glass beads, resin-coated sand and sintered bauxite.

10. The method of claim 6 wherein said treatment fluid contains a viscosifying agent consisting of at least one member selected from the group of galactomannans, glucomannans, and cellulose derivatives.

11. The method of claim 10 wherein said treatment fluid contains a crosslinking agent capable of crosslinking said viscosifying agent in said treatment fluid.

12. A remedial treatment for a well bore penetrating a subterranean coal-containing formation from which the flow of methane or other gases has been restricted by blockage of a propped fracture communicating with the well bore, which comprises:

introducing a treatment fluid into said fracture communicating with said well bore at a rate and pressure sufficient to reopen said fracture, maintaining said fracture in said open position for a sufficient period of time to permit at least a portion of any propping agent present in said fracture to settle to a lower portion of said fracture;

introducing a quantity of another treatment fluid substantially free of any propping agent into said fracture to create an open propping agent-free channel in the upper portion of said fracture; and permitting said fracture to close upon said settled propping agent to create a propped open channel through which methane and other gases can flow.

13. The method of claim 12 wherein said treatment fluid comprises water.

14. The method of claim 12 wherein said treatment fluid and said another treatment fluid are the same fluid.

* * * * *